US006514048B2

(12) United States Patent
Makino et al.

(10) Patent No.: US 6,514,048 B2
(45) Date of Patent: Feb. 4, 2003

(54) EXTERNAL CONTROL VARIABLE DISPLACEMENT COMPRESSOR

(75) Inventors: Yoshihiro Makino, Kariya (JP); Atsushi Shimizu, Kariya (JP); Masahiro Kawaguchi, Kariya (JP); Masaki Ota, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/918,157

(22) Filed: Jul. 30, 2001

(65) Prior Publication Data

US 2002/0015644 A1 Feb. 7, 2002

(30) Foreign Application Priority Data

Jul. 31, 2000 (JP) ..... 2000-231116

(51) Int. Cl.[7] ..... F04B 1/26; F04B 1/12

(52) U.S. Cl. ..... 417/222.2; 417/222.1; 417/269

(58) Field of Search ..... 417/222.2, 269, 417/423.14, 222.1; 92/71

(56) References Cited

U.S. PATENT DOCUMENTS 4,747,754 A * 5/1988 Fujii et al. ..... 417/222.2
4,875,832 A * 10/1989 Suzuki et al. ..... 251/129.17
5,145,325 A * 9/1992 Terauchi ..... 417/222.2
5,165,863 A * 11/1992 Taguchi ..... 417/222.2
5,865,604 A 2/1999 Kawaguchi et al. ..... 417/222.2
6,033,189 A 3/2000 Miura et al. ..... 417/222.2

FOREIGN PATENT DOCUMENTS

JP 8-338364 12/1996 ..... F04B/27/14
JP 10-318406 12/1998 ..... F16K/31/06

OTHER PUBLICATIONS

Random House College Dictionary, Revised Edition; Random House, Inc., New York; 1984, p. 27.*

* cited by examiner

*Primary Examiner*—Charles G. Freay
*Assistant Examiner*—Timothy P. Solak
(74) *Attorney, Agent, or Firm*—Morgan & Finnegan, LLP

(57) ABSTRACT

An external control variable displacement compressor varies its displacement based on the pressure in a control chamber. The compressor has a valve chamber defined in a housing. The valve chamber has an opening to accommodate an electrically operative control valve. The control valve controls pressure in the control chamber due to an external electrical signal. An electrical power supply line is connected to the control valve, the power supply line being in contact with an opening of the valve chamber. The valve chamber opening is surrounded by a circumferential wall. An agonic surface formed on the circumferential wall is constituted of a rounded surface formed by rounding a corner of the opening and/or a chamfered surface formed by chamfering a top of the opening, and is formed on a part of or the entire circumferential wall. The power supply line is to be in contact with the agonic surface.

8 Claims, 4 Drawing Sheets

EXTERNAL CONTROL VARIABLE DISPLACEMENT COMPRESSOR

BACKGROUND OF THE INVENTION

The present invention relates to variable displacement compressors that are used in vehicle air conditioners. More particularly, the present invention relates to an improvement of a housing for a control valve in the external control variable displacement.

U.S. Pat. No. 5,865,604, which corresponds to Japanese Unexamined Patent Publication No. 8-338364, describes a variable displacement compressor that the displacement is controlled by the pressure difference between the pressure in the control chamber and the pressure in the suction chamber. The displacement of the compressor is controlled by supplying refrigerant gas to the control chamber from the discharge chamber via a supply passage and releasing the gas into the suction chamber via a bleed passage. A displacement controlling structure of the compressor includes an electrically operative control valve in the passageway of the supply passage, which alters the size of an area of the supply passage. An energized solenoid of the control valve urges a valve body of the control valve toward the direction in which a valve hole closes. The value of the supplied current to the control valve is decided based on the comparison between predetermined temperature and detected temperature of a passenger compartment. A large difference between the detected temperature detected by a temperature sensor and the predetermined temperature set by a temperature controller indicates that cooling load is greatly needed. This causes the opening amount of the valve hole to become smaller. Thus, the inclination of a swash plate increases, and the discharge capacity of the compressor increases.

As shown in FIG. 5, an electrically operative control valve 80 is accommodated in a valve chamber 85 defined in a rear housing 90. The valve chamber 85 has an opening surrounded by a circumferential wall or a base portion 86 protruding from an outer circumferential wall surface of the rear housing 90. The base portion 86 forms annularly and an inner circumferential surface 87 of the base portion 86 has an annular recess 88. A circular clip 89 is fitted to the recess 88, by which prevents the control valve 80 from falling out of the valve chamber 85. A connector 81, a center of which protrudes outwardly, is arranged on the base portion and is provided with a connection assembly 82 to which an electrical power supply line 83 to energize the solenoid (not shown) is electrically connected. The power supply line 83 is covered with a cover 91 which protects the power supply line 83.

The control valve 80 is generally installed to the rear housing 90 and protrudes its end outwardly from the outer circumferential wall of the rear housing 90. This projection causes to hinder from installing a compressor to an object. Particularly, mounting a compressor on a vehicle as a part of air conditioner, a mounting space is restricted and the control valve 80 is required to reduce the projection from the outer circumferential wall of the rear housing 90.

According to the prior compressor, the connection assembly 82 of the connector 81 is set back from the base portion 86 toward the valve chamber 85. This arrangement of the connection assembly 82 frequently causes the power supply line 83, which connects an external drive circuit to the connection assembly 82, to contact with a periphery of the base portion 86. However, the prior compressor is only designed to define the valve chamber 85 to accommodate the control valve 80 and is not assumed the power supply line 83 to be in contact with the periphery of the base portion 86. Therefore, the periphery of the base portion remains edged.

Meanwhile, the power supply line 83 is protected by the cover 91, but the cover 91 does not protect until the connection assembly of the power supply line 83. A certain length of the uncovered power supply line 83 is necessary for electrical connecting to the connector 81. In other words, the power supply line 83 is not protected by the cover 91 in order to secure the efficiency of the connecting work.

When the uncovered power supply line 83 contacts with a periphery of the base portion, long-term vibration of the compressor and an engine to which the compressor is installed cause the contact surface of the power supply line 83 to wear out.

SUMMARY OF THE INVENTION

The present invention contemplates to alleviate the above-mentioned inconveniences. Accordingly, it is an object of the present invention to provide an external control variable displacement compressor which is capable of preventing an electrical power supply line of an electrically operative control valve from wearing out.

To achieve this object, an external control variable displacement compressor has a housing, a control chamber defined in the housing and an electrically operative control valve accommodated in the housing to control pressure in the control chamber. The displacement of the compressor is varied based on the pressure in the control chamber. The control valve controls the pressure in the control chamber due to an external electrical signal. A valve chamber which is defined in the housing has an opening to accommodate the control valve and an agonic surface formed at the opening. An electrical power supply line connected to the control valve is in contact with the agonic surface. According to the present invention, when the power supply line is in contact with the opening of the valve chamber, the agonic surface supports the power supply line, which prevents the power supply line from wearing out.

Furthermore, the present invention has such a feature that the agonic surface is formed on a part of a circumferential wall surrounding the opening.

Furthermore, the present invention has a following feature that the circumferential wall formed along the valve chamber opening protrudes from an outer circumferential wall surface of the housing and the projection of the agonic surface from the outer circumferential wall surface of the housing is less than the rest of the circumferential wall. According to the present invention, even if the circumferential wall protrudes from the outer circumferential wall surface, contact stress of the power supply line against the circumferential wall becomes smaller than that of the prior compressor.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 2:
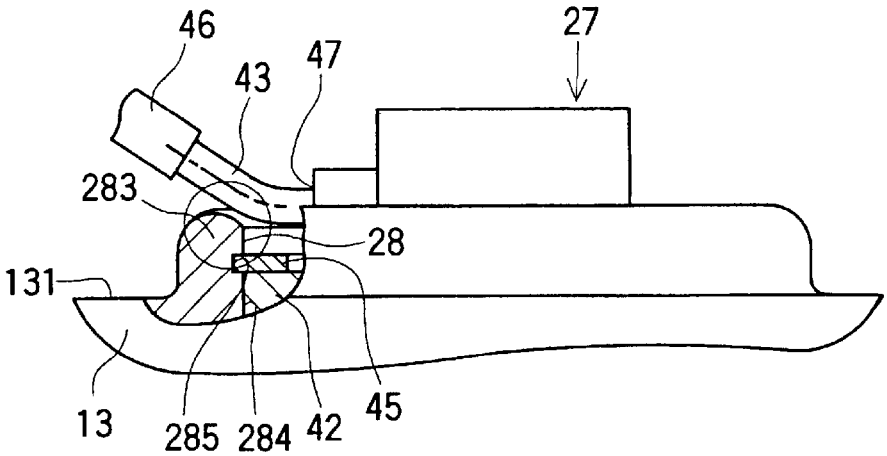
FIG. 2 is an enlarged partial side view, with a part cut away, illustrating a base portion of a valve chamber of FIG. 1.
Figure 3:
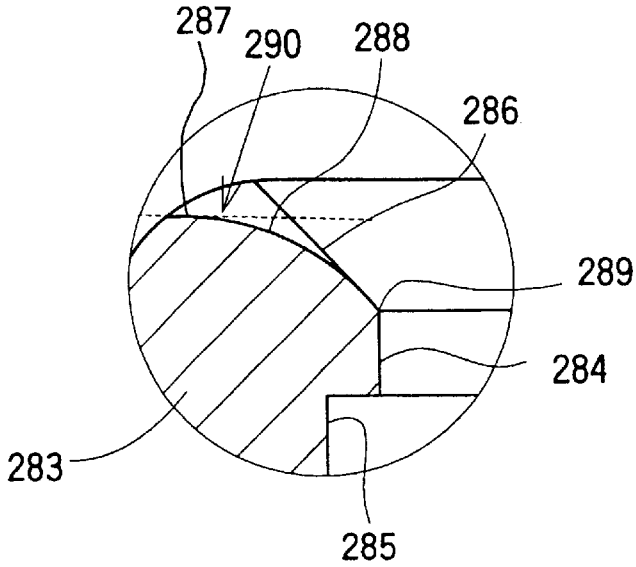
FIG. 3 is an enlarged cross-sectional partial side view illustrating an embodiment of the present invention.

An embodiment of the present invention will now be described with reference to FIGS. 1 through 3.

Figure 1:
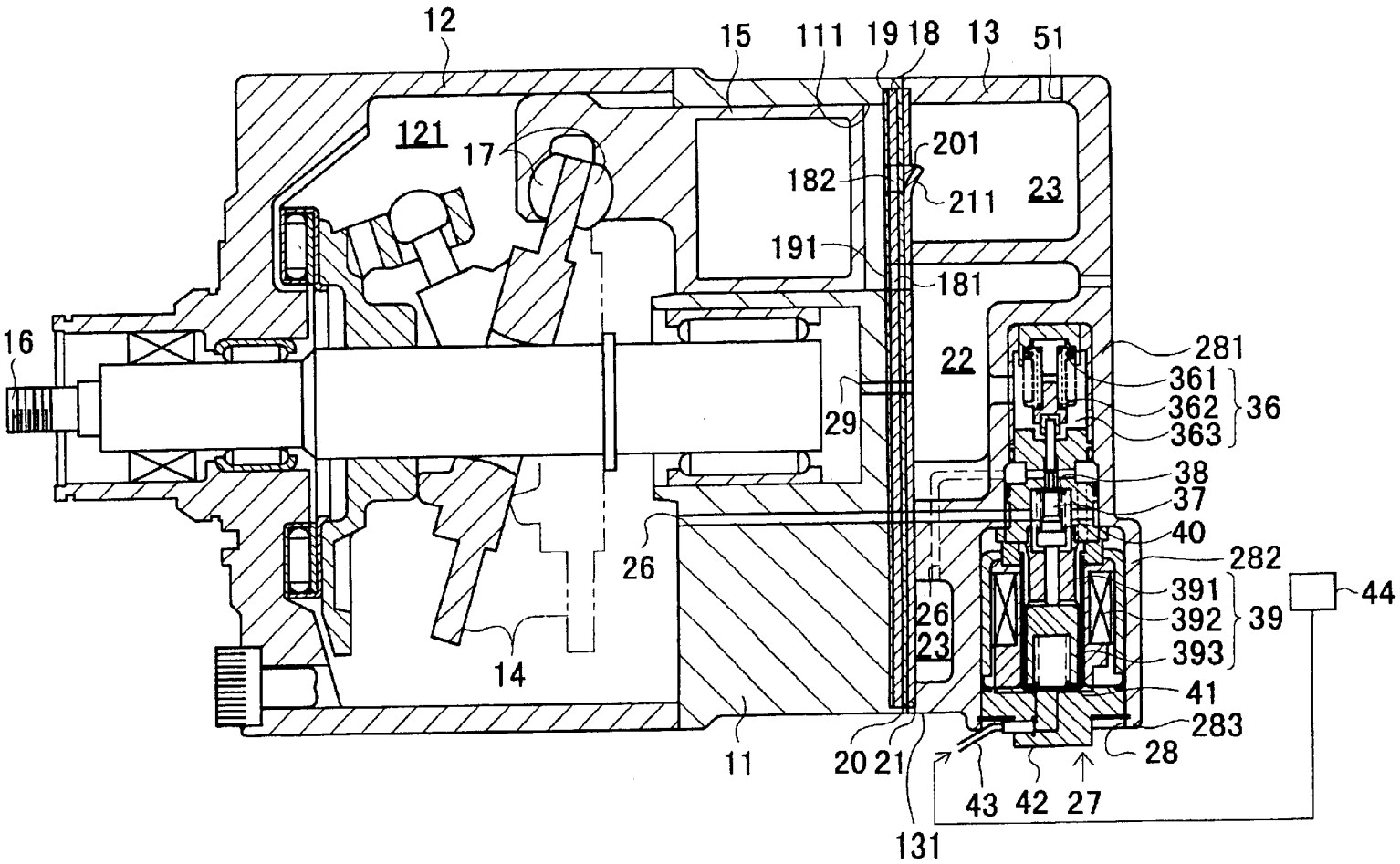
FIG. 1 is a cross-sectional side view of a compressor according to an embodiment of the present invention.

As shown in FIG. 1, a compressor housing is constituted of a front housing 1 2, a cylinder block 11 and a rear housing 13. The front housing, 12 is coupled to the front end of the cylinder block 11. The rear housing 13 is coupled to the rear end of the cylinder block 11 with a valve plate 18, a suction valve plate 19, a discharge valve plate 20 and a retainer plate 21 fixed therebetween. A suction chamber 22 and a discharge chamber 23 are defined in the rear housing 13. A control chamber 121 is defined in the front housing 12. A drive shaft 16 extends through the front housing 12 and the cylinder block 11 and is rotatably supported by the housing. A swash plate 14 is supported by the drive shaft 16 in a manner allowing the swash plate 14 to rotate integrally and tilt with respect to the drive shaft 16. A plurality of cylinder bores 111 are formed in the cylinder block 11 around the drive shaft 16 at same interval. Each bore 111 accommodates a piston 15 so as to reciprocate. Each piston 15 is operatively coupled to the swash plate 14 by a pair of shoes 17. The rotation of the drive shaft 16 is transmitted to each piston 15 by way of the swash plate 14 and the shoes 17 and is converted to reciprocation of each piston 15 in the associated cylinder bore 111.

Suction ports 181 are defined in the valve plate 18, which communicate to the suction chamber 22 and each cylinder bore 111, respectively. Discharge ports 182 are also defined in the valve plate 18 and in the suction valve plate 19, which communicate to the discharge chamber 23 and each cylinder bore 1 11, respectively. Suction valves 191 are formed on the suction valve plate 19. Discharge valves 201 are formed on the discharge valve plate 20. The suction valve 191 opens and closes the suction port 181. The discharge valve 201 opens and closes the discharge port 182.

As the drive shaft 16 is rotated by an external drive source (not shown) and the piston 15 is moved from a top dead center to a bottom dead center, refrigerant gas in the suction chamber 22 forces out the suction valve 191 and flows into the cylinder bore 111 via the suction port 181. As the piston 15 is moved from the bottom dead center to the top dead center, the refrigerant gas sucked into the cylinder bore 111 is compressed to a predetermined pressure. The compressed refrigerant gas in the cylinder bore 111 forces out the discharge valve 201 and flows into the discharge chamber 23 via the discharge port 182. An opening degree of the discharge valve 201 is regulated by abutting with a retainer 211 which is formed on the retainer plate 21. The refrigerant gas in the discharge chamber 23 is discharged into an external refrigerant circuit (not shown) via a discharge passage 51. The refrigerant gas flown into the external refrigerant circuit flows back to the suction chamber 22 via a condenser, an expansion valve and an evaporator arranged on the external refrigerant circuit.

The suction chamber 22 communicates with the control chamber 121 via a bleed passage 29. The discharge chamber 23 communicates with the control chamber 121 via a supply passage 26 in which an electrically operative control valve 27 is arranged. The valve chamber 28 which is bored to define in the rear housing 13 accommodates the control valve 27. The supply passage 26 supplies the refrigerant gas in the discharge chamber 23 to the control chamber 121.

A solenoid 39 of the control valve 27 is energized in accordance with the value of supplied current or signal which is to flow from a drive circuit 44. A controller (not shown) control's the drive circuit 44 to flow the electric current in response to the difference between compartment temperature detected by a temperature sensor (not shown) and predetermined temperature set by a temperature controller (not shown).

The pressure in the suction chamber 22 (suction pressure) acts on a bellows 361 via a pressure sensing chamber 363. The suction pressure in the suction chamber 22 reflects a cooling load. A valve body 37 is connected to the bellows 361, and opens and closes a valve hole 38. An atmospheric pressure in the bellows 361 and an urging force of a pressure sensing spring 362 urge the valve body 37 to open the valve hole 38. The bellows 361, the pressure sensing chamber 363 and the spring 362 constitute sensing means 36. The energized solenoid 39 by supplied current to a coil 392 draws a movable core 393 toward a fixed core 391, the cores 391, 393 and the coil 392 constituting the solenoid 39 of the control valve 27. In other words, an electromagnetic force of the solenoid 39 urges the valve body 37 to close the valve hole 38 against an urging force of an open-urging spring 40. A follow-up spring 41 urges the movable core 393 toward the fixed core 391. An opening amount of the valve hole 38 is determined by a resultant force of the electromagnetic force of the solenoid 39, the urging force of the follow-up spring 41, the urging force of the open-urging spring 40 and the urging force of the sensing means 36. The control valve 27 acts in correspondence to the value of supplied current.

When the value of supplied current increases, the opening amount of the valve hole 38 decreases and the amount of refrigerant gas from the discharge chamber 23 to the control chamber 121 decreases. The refrigerant gas in the control chamber 121 flows out via the bleed passage 29, which causes the pressure in the control chamber 121 to decrease. Accordingly, an inclination angle of the swash plate 14 increases and the discharge capacity of the compressor increases. As the value of supplied current decreases, the opening amount of the valve hole 38 increases and the amount of supplied refrigerant gas from the discharge chamber 23 to the control chamber 121 increases. Consequently, as the pressure in the control chamber 121 increases, the inclination angle of the swash plate 14 decreases and the discharge capacity of the compressor decreases.

As the value of supplied current to the solenoid 39 is zero, the opening amount of the valve hole 38 becomes maximum. As shown in FIG. 1, two-dot chain line indicates that the inclination angle of the swash plate 14 becomes minimum. As the electric current resumes flowing, the opening amount of the valve hole 38 becomes smaller and the pressure in the control chamber 121 decreases. Accordingly, the inclination of the swash plate 14 increases from the minimum.

The above-mentioned compressor has the same structure as those in the prior external control variable displacement compressor. Now an embodiment of the present invention will be described as the following.

As shown in FIG. 1, the valve chamber 28 defined in the rear housing 13 is constituted of a small diameter portion 281 which accommodates the sensing means 36 of the control valve 27 and a large diameter portion 282 is surrounded at its opening by a circumferential wall or a base portion 283 protruding from an outer circumferential wall surface 131 of the rear housing 13. As shown in FIGS. 2 and 3, an annular recess 285 is formed on: an inner circumferential surface 284 of the base portion 283. As shown in FIG. 3, an annular tapered surface 286 is formed along the inner peripheral surface and is inclined toward outwardly therefrom. This annular tapered surface 286 is formed around the opening of the base portion 283, on which a partial periphery of the base portion 283 is formed as a groove 290. The groove 290 is formed by the steps of (1) chamfering in a direction perpendicular to the inner surface of the valve chamber 28 a top of the base portion where the groove is formed, so as to make a chamfered surface 287 and reduce the height there relative to the rest of the base portion, and (2) rounding a corner between the chamfered surface 287 and the tapered surface 286 to make an agonic surface thereon. Therefore, the agonic groove 290 is constructed by three surfaces, chamfered, rounded and tapered surfaces. The projection of the groove 290 from the outer circumferential wall surface 131 of the housing is less than the rest of the base portion 283. As shown in FIG. 3, a chain line indicates a plane of the chamfered surface elongatedly.

The above-mentioned valve chamber 28 accommodates the control valve 27. As shown in FIGS. 1 and 2, a connector 42 is formed on the solenoid 39 side of the control valve 27. The connector 42 has a projection on its central surface, and the power supply line 43 extends toward a direction perpendicular to the inner circumferential surface 284 from a connection assembly 47 of the projection. The above-mentioned groove 290 is formed on a direction to which the power supply line 43 extends over. A cover 46 which protects the power :supply line 43 covers the power supply line 43 just before the base portion 283. The power supply line 43 plunges its end into the valve chamber 28, extends over the base portion 283 so as to be in contact with the groove 290 formed on the base portion 283 and is connected to the drive circuit 44. The control valve 27 is fixed into the valve chamber 28 by means of a circular clip 45 fitted in an annular recess 285 being in contact with the connector 42 end. Besides, as shown in FIG. 2, the power supply line 43 is not in contact with the groove 290 because of avoiding the figure being complicated. The power supply line 43 is in contact with the groove 290 in the actual embodiment.

The above-mentioned embodiment allows the following advantageous effects to be obtained.

The tapered surface 288 with which the power supply line 43 is in contact is chamfered and is rounded. Accordingly, not covered with the cover 46, the power supply line 43 is received by an agonic plane or a curved surface. This protects the power supply line 43 from wearing out with the vibration of a compressor and an engine.

Furthermore, the groove 290 is constituted of the tapered surface 288, chamfered surface 287 and rounded surface, and the projection of the groove 290 is less than the rest of the base portion 283. Accordingly, a deformation for the power supply line 43 extending over the base portion 283 can be reduced, and the power supply line 43 lasts better than that of the prior art.

Without departing from the spirit or scope of the invention, for example, the following modes allow the same advantageous effects of the embodiment to be obtained.

Figure 4A:
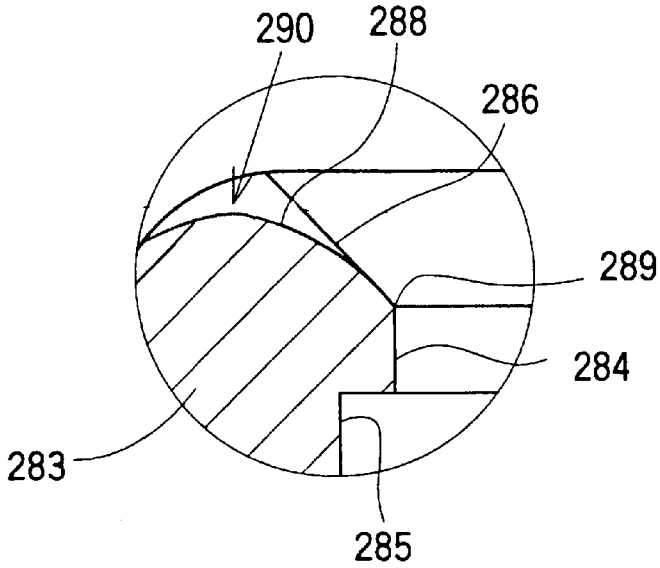
FIG. 4*a* is an enlarged cross-sectional partial side view illustrating another embodiment of the present invention.

The agonic surface groove can be formed by only rounding a predetermined portion of the base portion 283, as shown in FIG. 4*a*. The same advantageous effects can be obtained.

Figure 4B:
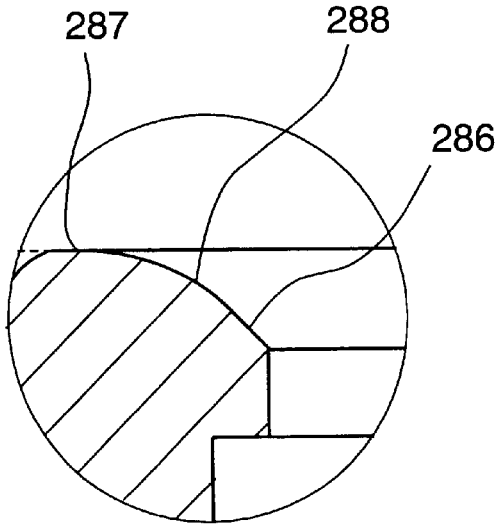
FIG. 4*b* is an enlarged cross-sectional partial side view illustrating another embodiment of the present invention.
Figure 5:
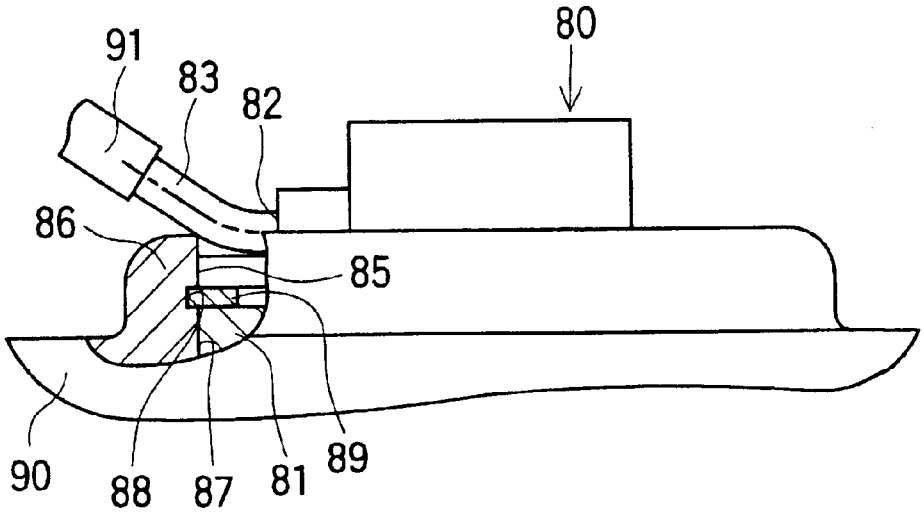
Fig. 5 (Prior Art)
FIG. 5 is an enlarged partial side view, with a part cut away, illustrating a base portion of a prior art valve chamber.

As shown in FIG. 4*b*, not forming the groove 290 but chamfering and rounding the far-ranging or the entire base portion periphery allow the power supply line 43 to be connected more freely.

The compressor of the embodiment protrudes its base portion 283 of the valve chamber 28 from the outer circumferential wall 131 of the rear housing. However, a compressor which its base portion does not protrude can be embodied.

Therefore, the present examples and embodiments are to be considered as illustrative and not restrictive and the invention is not to be limited to the details given herein but may be modified within the scope of the appended claims.

What is claimed is:

1. An external control variable displacement compressor including a housing, a control chamber defined in the housing and an electrically operative control valve accommodated in the housing to control pressure in the chamber, wherein the displacement of the compressor is varied based on the pressure in the chamber, and wherein the control valve controls due to an external electrical signal, the compressor comprises:

an electrical power supply line connected to the control valve;

a valve chamber defined in the housing, said valve chamber having an opening to accommodate the control valve and an agonic surface formed at the opening, said agonic surface being in contact with and supporting said power supply line.

2. An external control variable displacement compressor according to claim 1, wherein said agonic surface is formed on a part of a circumferential wall formed along said valve chamber opening.

3. An external control variable displacement compressor according to claim 2, wherein said circumferential wall protrudes from an outer circumferential wall of the housing, and wherein the projection of said agonic surface is less than that of the rest of said circumferential wall.

4. An external control variable displacement compressor according to claim 2, wherein said agonic surface forms a rounded surface.

5. An external control variable displacement compressor according to claim 1, wherein the opening of said valve chamber is surrounded by a circumferential wall which protrudes from the housing, the wall having a groove on which said agonic surface is formed.

6. An external control variable displacement compressor according to claim 5, wherein said agonic surface comprises a tapered surface formed to cut off the opening edge of said circumferential wall, a chambered surface formed by chamfering a top of said circumferential wall and a rounded surface formed by rounding a corner between the tapered and chamfered surfaces.

7. An external control variable displacement compressor according to claim 5, wherein said agonic surface is formed entirely on the groove.

8. An external control variable displacement compressor according to claim 1, wherein the opening of said valve chamber is surrounded by a circumferential wall which protrudes from the housing, and wherein said agonic surface is formed on the entire circumferential wall.

* * * * *